US012703890B2

(12) United States Patent
Cho et al.

(10) Patent No.: US 12,703,890 B2
(45) Date of Patent: Aug. 11, 2026

(54) HIGH-STRENGTH STEEL SHEET HAVING EXCELLENT BENDABILITY AND FORMABILITY AND METHOD FOR MANUFACTURING SAME

(71) Applicant: POSCO CO., LTD, Pohang-si (KR)

(72) Inventors: Kyoung-Rae Cho, Gwangyang-si (KR); Hee-Su Park, Gwangyang-si (KR); Hyun-Gyu Hwang, Gwangyang-si (KR); Sung-Kyu Kim, Gwangyang-si (KR); Chang-Hyo Seo, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 464 days.

(21) Appl. No.: 18/265,414

(22) PCT Filed: Nov. 22, 2021

(86) PCT No.: PCT/KR2021/017156
§ 371 (c)(1),
(2) Date: Jun. 5, 2023

(87) PCT Pub. No.: WO2022/131596
PCT Pub. Date: Jun. 23, 2022

(65) Prior Publication Data

US 2024/0026485 A1 Jan. 25, 2024

(30) Foreign Application Priority Data

Dec. 14, 2020 (KR) ..... 10-2020-0174332

(51) Int. Cl.
*C21D 9/46* (2006.01)
*C21D 8/0221* (2026.01)
(Continued)

(52) U.S. Cl.
CPC ..... *C21D 9/46* (2013.01); *C21D 8/0226* (2013.01); *C21D 8/0236* (2013.01);
(Continued)

(58) Field of Classification Search
CPC ..... C21D 9/46; C21D 8/0226; C21D 8/0236; C21D 8/0263; C21D 8/0273;
(Continued)

(56) References Cited

U.S. PATENT DOCUMENTS 11,753,693 B2 9/2023 Im et al.
2014/0212684 A1* 7/2014 Kawata ..... C23C 2/02 148/533
(Continued)

FOREIGN PATENT DOCUMENTS

CN 103842543 A 6/2014
CN 111511951 A 8/2020
(Continued)

OTHER PUBLICATIONS

Japanese Office Action—Japanese Application No. 2023-535638 issued on Aug. 6, 2024, citing JP 2007-009317, EP 3730635, and WO 2013/099235.
(Continued)

*Primary Examiner* — Danielle M. Carda
(74) *Attorney, Agent, or Firm* — CANTOR COLBURN LLP

(57) ABSTRACT

Provided are a high-strength steel sheet having excellent bendability and formability, and a method for manufacturing same. The steel sheet includes: 0.05 to 0.12% of carbon (C), 2.0 to 3.0% of manganese (Mn), 0.5% or less (excluding 0%) of silicon (Si), 1.0% or less (excluding 0%) of chromium (Cr), 0.1% or less (excluding 0%) of niobium (Nb), 0.1% or less (excluding 0%) of titanium (Ti), 0.0025% or less (excluding 0%) of boron (B), 0.02 to 0.05% of alumi-
(Continued)

num (sol.Al), 0.05% or less (excluding 0%) of phosphorus (P), 0.01% or less (excluding 0%) of sulfur (S), 0.01% or less (excluding 0%) of nitrogen (N), with a balance of Fe and inevitable impurities, and 35 to 50% of ferrite and 35 to 45% of bainite, and a balance of martensite, the ferrite comprising, by area fraction: 8 to 15% of non-recrystallized ferrite and 27 to 35% of recrystallized ferrite, as a microstructure.

12 Claims, 4 Drawing Sheets

(51) Int. Cl.

| | |
|---|---|
| ***C21D 8/0247*** | (2026.01) |
| ***C22C 38/00*** | (2006.01) |
| ***C22C 38/02*** | (2006.01) |
| ***C22C 38/06*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(52) U.S. Cl.
CPC ..... *C21D 8/0263* (2013.01); *C21D 8/0273* (2013.01); *C22C 38/001* (2013.01); *C22C 38/002* (2013.01); *C22C 38/02* (2013.01); *C22C 38/06* (2013.01); *C22C 38/26* (2013.01); *C22C 38/28* (2013.01); *C22C 38/32* (2013.01); *C22C 38/38* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 2211/001; C21D 2211/002; C21D 2211/005; C21D 2211/008; C21D 1/22; C21D 1/19; C21D 8/0205; C21D 8/0221; C21D 8/02; C22C 38/001; C22C 38/002; C22C 38/02; C22C 38/06; C22C 38/26; C22C 38/28; C22C 38/32; C22C 38/38; C22C 38/04
USPC ..... 148/661
See application file for complete search history.

(56) References Cited

U.S. PATENT DOCUMENTS

| | | | | |
|---|---|---|---|---|
| 2014/0234659 | A1 | 8/2014 | Kawata et al. | |
| 2014/0342184 | A1 | 11/2014 | Takagi et al. | |
| 2016/0355903 | A1 | 12/2016 | Kwak et al. | |
| 2018/0281348 | A1 | 10/2018 | Otomo et al. | |
| 2019/0003002 | A1 | 1/2019 | Seo | |
| 2019/0338403 | A1* | 11/2019 | Ahn | C22C 38/001 |
| 2022/0154302 | A1 | 5/2022 | Kawata | |

FOREIGN PATENT DOCUMENTS

| | | | | | |
|---|---|---|---|---|---|
| EP | 2738280 | A1 | | 6/2014 | |
| EP | 3730635 | | | 10/2020 | |
| JP | 2005264176 | | | 9/2005 | |
| JP | 2007009317 | A | | 1/2007 | |
| JP | 2010090432 | | | 4/2010 | |
| JP | 2016188395 | A | | 11/2016 | |
| KR | 20130074503 | | | 7/2013 | |
| KR | 20140041833 | | | 4/2014 | |
| KR | 20140047960 | | | 4/2014 | |
| KR | 20150073844 | | | 7/2015 | |
| KR | 20150075311 | | | 7/2015 | |
| KR | 101736619 | | | 5/2017 | |
| KR | 20180043331 | | | 4/2018 | |
| KR | 20190076258 | | | 7/2019 | |
| KR | 20190076258 | A | * | 7/2019 | C23C 2/06 |
| WO | 2013099235 | A1 | | 7/2013 | |
| WO | 2020067752 | A1 | | 4/2020 | |
| WO | 2020208979 | A1 | | 10/2020 | |

OTHER PUBLICATIONS

European Search Report—European Application No. 21906901.0 issued on May 7, 2024, citing EP 2738280, EP 3730635, and WO 2020/067752.

Chinese Office Action—Chinese Application No. 202180084341.X issued on Apr. 8, 2025, citing WO 2020-208979 A1, CN 111511951 A, CN 103842543 A, JP 2016-188395 A, and Application Manual of Metal Heat Treatment Standards.

Application Manual of Metal Heat Treatment Standards, Jan. 2016, 3rd version, Edited by National Standardization Technical Committee on Heat Treatment, pp. 852-853.

International Search Report—PCT/KR2021/017156 dated Mar. 11, 2022.

* cited by examiner

HIGH-STRENGTH STEEL SHEET HAVING EXCELLENT BENDABILITY AND FORMABILITY AND METHOD FOR MANUFACTURING SAME

TECHNICAL FIELD

The present disclosure relates to a steel suitable for an automotive material, and more particularly, to a high-strength steel sheet having excellent bendability and formability and a method for manufacturing the same.

BACKGROUND ART

In recent years, the use of a high-strength steel is demanded for improving fuel efficiency and durability, due to environmental regulations related to $CO_2$ emission and energy use regulations in the automobile industry.

In particular, as regulations for impact stability of automobiles have expanded, a high-strength steel having excellent strength is being employed as a material of structural members such as a body member, a seat rail, and a pillar for improving impact resistance of a car body.

Since these automotive parts may have a complicated shape depending on their stability and design, and are manufactured by forming with a press mold, a high level of formability together with high strength is required of the automotive parts.

As the strength of steel is high, the steel is favorable for impact energy absorption, but generally, when the strength of steel is increased, elongation is decreased to reduce formability. Besides, when yield strength is excessively high, introduction of a material into a mold during forming is decreased to deteriorate formability and increase manufacturing costs.

In addition, as automotive parts may have a plurality of forming areas in which a hole is processed and then expands, bendability is required for smooth forming, but a high-strength steel has low bendability to cause defects such as cracks during forming. As such, when bendability is poor, cracks may occur in a component formed portion upon automobile collision to easily break the component, so that the safety of passengers may be endangered.

Meanwhile, a high-strength steel used as an automotive material includes, representatively, a dual phase steel (DP steel), a transformation induced plasticity steel (TRIP steel), a complex phase steel (CP steel), a ferrite-bainite steel (FB steel), and the like.

Since a DP steel which is an ultra-high strength steel has a low yield ratio of about 0.5 to 0.6, it is easy to process, and has a second highest elongation after a TRIP steel. Thus, it is mainly applied to a door outer panel, a seat rail, a seat belt buckle, a suspension member, an arm member, a wheel disc, and the like.

Since TRIP steel has a yield ratio in a range of 0.57 to 0.67, it is characterized by having excellent formability (high ductility), and is suitable for parts requiring high formability such as a member, a roof, a seat belt, and a bumper rail.

CP steel is applied to a side panel, an underbody reinforcement, and the like due to having high elongation and bending processability together with a low yield ratio, and a FB steel has excellent hole expandability and is mainly applied to a suspension lower arm, a wheel disc, and the like.

Thereamong, a DP steel is formed of ferrite having excellent ductility and a hard phase (martensite phase, bainite phase) having high strength, and a trace amount of residual austenite may exist therein. The DP steel as such has low yield strength and high tensile strength to have a low yield ratio (YR), and has excellent characteristics such as a high work hardening rate, high ductility, continuous yield behavior, aging resistance at room temperature, bake hardenability, and the like. In addition, when a fraction, a degree of recrystallization, distribution uniformity, and the like of each phase are controlled, the steel may be manufactured as a high-strength steel having high bendability.

However, in order to secure an ultra-high strength of a tensile strength of 980 MPa or more, the fraction of a hard phase such as a martensite phase which is favorable to strength improvement should be increased, and in this case, yield strength is increased to cause defects such as cracks during press forming.

In general, a DP steel for an automobile is manufactured as a final product by manufacturing a slab by steelmaking and casting processes, subjecting the slab to [heating—rough rolling—finish hot rolling] to obtain a hot-rolled coil, and then performing an annealing process.

Here, an annealing process is a process performed mainly in the manufacturing of a cold-rolled steel sheet, and the cold rolled steel sheet is manufactured by pickling a hot-rolled coil to remove surface scale, performing cold rolling to a certain reduction ratio at room temperature, and then performing an annealing process, and, if necessary, an additional temper rolling process.

Since a cold-rolled steel sheet obtained by cold rolling is in a very hardened state itself and is unsuitable for manufacturing parts requiring workability, it may be softened by a heat treatment in a continuous annealing furnace as a subsequent process to improve workability.

As an example, in the annealing process, a steel sheet (cold-rolled material) is heated to about 650 to 850° C. in a heating furnace and the temperature is maintained for a certain amount of time, thereby lowering hardness and improving workability through recrystallization and phase transformation phenomena.

A steel sheet which is not subjected to the annealing process has a high hardness, in particular, a high surface hardness and lacks workability, while a steel sheet subjected to an annealing process has a recrystallization structure, thereby having lowered hardness, yield point, and tensile strength to promote improvements of workability.

As a representative method of lowering the yield strength of a DP steel, ferrite is completely recrystallized in a heating process during continuous annealing to be manufactured in an equiaxed crystal form, so that austenite is produced and grows in a subsequent process to be the equiaxed crystal form, and thus, it is favorable for forming a small-sized and uniform austenite phase.

Meanwhile, as a conventional technology for improving workability of a high-strength steel, Patent Document 1 suggests a method according to structural refinement, and specifically, discloses a method of dispersing fine precipitates copper particles of 1 to 100 nm in the structure for a composite structure steel sheet having a martensite phase as a main body. However, since the technology requires addition of 2-5% of Cu for obtaining good fine precipitation phase particles, red-hot brittleness due to a large amount of Cu may occur, and manufacturing costs are excessively increased.

Patent Document 2 discloses a steel sheet which has a structure including ferrite as a matrix structure and 2 to 10% by area of pearlite, and improving strength through precipitation strengthening and crystal grain refinement by adding a carbonitride forming element (e.g., Ti and the like). While the steel sheet is good in terms of hole expandability, there are limitations in further increasing tensile strength, and there is a problem in that cracks occur during press forming due to high yield strength and low ductility.

Patent Document 3 discloses a technology of manufacturing a cold-rolled steel sheet simultaneously obtaining high strength and high ductility using a tempered martensite phase, and also having an excellent plate shape after continuous annealing, but there is a problem of poor weldability when a content of carbon (C) is high, 0.2% or more, and there is a problem of occurrence of dent defects in a furnace due to addition of a large amount of Si.

Considering the prior arts described above, in order to improve formability such as bendability of a high-strength steel, satisfying physical properties such as weldability, or the like, development of a method capable of lowering a yield strength and improving ductility, is required.

(Patent Document 1) Japanese Patent Laid-Open Publication No. 2005-264176

(Patent Document 2) Korean Patent Laid-Open Publication No. 2015-0073844

(Patent Document 3) Japanese Laid-Open Patent Publication No. 2010-090432

SUMMARY OF INVENTION

Technical Problem

An aspect of the present disclosure is to provide a high-strength steel sheet having excellent formability such as bendability, or the like by improving ductility while having a low yield ratio and high strength, and a method for manufacturing the same.

An object of the present disclosure is not limited to the above description. The object of the present disclosure will be understood from the entire content of the present specification, and a person skilled in the art to which the present disclosure pertains will understand an additional object of the present disclosure without difficulty.

Solution to Problem

According to an aspect of the present disclosure, provided is a high-strength steel sheet having excellent bendability and formability, the high-strength steel sheet including, by weight: 0.05 to 0.12% of carbon (C), 2.0 to 3.0% of manganese (Mn), 0.5% or less (excluding 0%) of silicon (Si), 1.0% or less (excluding 0%) of chromium (Cr), 0.1% or less (excluding 0%) of niobium (Nb), 0.1% or less (excluding 0%) of titanium (Ti), 0.0025% or less (excluding 0%) of boron (B), 0.02 to 0.05% of aluminum (sol.Al), 0.05% or less (excluding 0%) of phosphorus (P), 0.01% or less (excluding 0%) of sulfur (S), 0.01% or less of nitrogen (N) (excluding 0%), with a balance of Fe and inevitable impurities.

wherein the high-strength steel sheet includes, by area fraction: 35 to 50% of ferrite and 35 to 45% of bainite, and a balance of martensite, the ferrite including, by area fraction: 8 to 15% of non-recrystallized ferrite and 27 to 35% of recrystallized ferrite, as a microstructure.

According to another aspect of the present disclosure, provided is a method for manufacturing a high-strength steel sheet having excellent bendability and formability, the method including operations of: preparing a steel slab including by weight: 0.05 to 0.12% of carbon (C), 2.0 to 3.0% of manganese (Mn), 0.5% or less (excluding 0%) of silicon (Si), 1.0% or less (excluding 0%) of chromium (Cr), 0.1% or less (excluding 0%) of niobium (Nb), 0.1% or less (excluding 0%) of titanium (Ti), 0.0025% or less (excluding 0%) of boron (B), 0.02 to 0.05% of aluminum (sol.Al), 0.05% or less (excluding 0%) of phosphorus (P), 0.01% or less (excluding 0%) of sulfur (S), 0.01, or less (excluding 0%) of nitrogen (N), with a balance of Fe and inevitable impurities; heating the steel slab at a temperature within in a range of 1100 to 1300° C.; subjecting the heated steel slab to hot rolling to manufacture a hot-rolled steel sheet; coiling the hot-rolled steel sheet at a temperature within a range of 400 to 700° C.; cooling the hot-rolled steel sheet to room temperature after the coiling; subjecting the cooled hot-rolled steel sheet to cold rolling to manufacture a cold-rolled steel sheet; continuously annealing the cold-rolled steel sheet; primary cooling the steel sheet to a temperature within a range of 650 to 700° C. at an average cooling rate of 1 to 10° C./s after the continuous annealing; and secondary cooling the steel sheet to a temperature within a range of 300 to 580° C. at an average cooling rate of 5 to 50° C./s after the primary cooling, wherein the cold rolling is performed in 7 passes or less, and a total reduction ratio is 55 to 70%.

Advantageous Effects of Invention

As set forth above, according to the present disclosure, a steel sheet having excellent bendability (3-point bendability) despite having high strength and improved formability and collision resistance may be provided.

As described above, since the steel sheet of the present disclosure having improved formability may prevent processing defects such as cracks, wrinkles, or the like, during press forming, the steel sheet may be suitably applied to parts such as structures requiring processing into complex shapes. Furthermore, it is also effective in manufacturing a material having improved collision resistance so that defects such as cracks, or the like are not easily formed when a vehicle to which such a part is applied unavoidably collides.

BEST MODE FOR INVENTION

Figure 1:
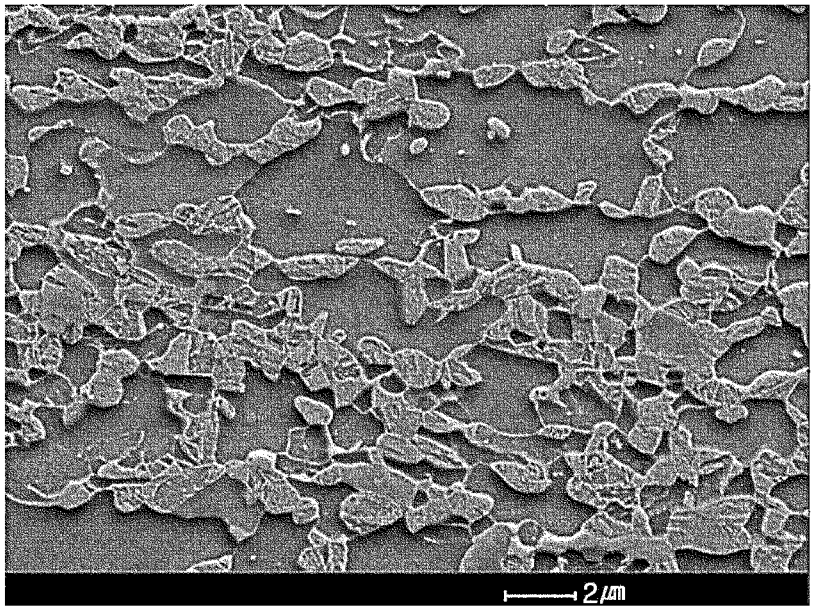
FIG. 1 illustrates a photograph of a microstructure of Inventive Steel according to an embodiment of the present disclosure.
Figure 1:
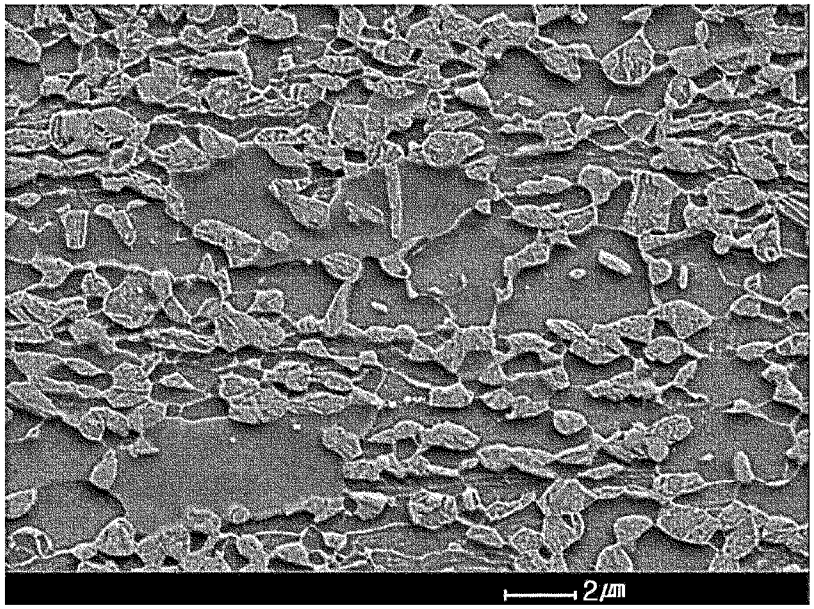

The inventors of the present invention conducted in-depth research to develop a material having a level of formability that can be suitably used for parts requiring processing into complex shapes among automotive materials.

In particular, the present inventors have confirmed that the objective could be achieved by inducing sufficient recrystallization of a soft phase affecting ductility of steel, and thus the present disclosure was provided.

Hereinafter, the present disclosure will be described in detail.

According to an aspect of the present disclosure, a high-strength steel sheet having excellent bendability and formability may include, by weight: 0.05 to 0.12% of carbon (C), 2.0 to 3.0% of manganese (Mn), 0.5% or less (excluding 0%) of silicon (Si), 1.0% or less (excluding 0%) of chromium (Cr), 0.1% or less (excluding 0%) of niobium (Nb), 0.1% or less (excluding 0%) of titanium (Ti), 0.0025% or less (excluding 0%) of boron (B), 0.02 to 0.05% of aluminum (sol.Al), 0.05% or less (excluding 0%) of phosphorus (P), 0.01% or less (excluding 0%) of sulfur (S), 0.01% or less (excluding 0%) of nitrogen (N).

Hereinafter, the reason for which the alloy composition of the steel sheet provided in the present disclosure is limited as described above will be described in detail.

Meanwhile, unless otherwise particularly stated in the present disclosure, the content of each element is by weight and the ratios of the structure is by area.

Carbon (C): 0.05 to 0.12%

Carbon (C) is an important element added for solid solution strengthening, and is bonded to a precipitation element to form a fine precipitate, thereby contributing to strength improvement of steel.

When the content of C exceeds 0.12%, hardenability is increased to form martensite during cooling in the manufacture of steel, thereby excessively increasing strength, while causing a decrease in elongation. In addition, weldability is poor, so that weld defects may occur in processing into parts. Meanwhile, when the content of C is less than 0.05%, it is difficult to secure a target level of strength.

Therefore, C may be included in an amount of 0.05 to 0.12%. More favorably, C may be included in an amount of 0.06% or more and 0.10% or less.

Manganese (Mn): 2.0 to 3.0%

Manganese (Mn) is an element precipitating sulfur (S) in steel as MnS to prevent hot brittleness by production of FeS, and is favorable to solid solution strengthening of steel.

When the content of Mn is less than 2.0%, the effects described above may not be obtained, and it is difficult to secure a target level of strength. On the other hand, when the content exceeds 3.0%, problems in weldability, hot rolling, and the like are likely to occur, and also, martensite is more easily formed by an increase in hardenability, so that ductility may be decreased. In addition, a Mn-band (Mn oxide band) is excessively formed in the structure to increase the risk of defects such as processing cracks. Further, a Mn oxide is eluted on the surface during annealing to greatly deteriorate plating properties.

Therefore, Mn may be included in an amount of 2.0 to 3.0%, and more favorably at 2.2 to 2.8%.

Silicon (Si): 0.5% or Less (Excluding 0%)

Silicon (Si) is a ferrite stabilizing element, and promotes ferrite transformation to be favorable to securing a target level of ferrite fraction. In addition, it has good solid solution strengthening ability to be effective to increase strength of ferrite, and is an element useful for securing strength while not decreasing ductility.

When the content of Si exceeds 0.5%, the solid solution strengthening effect is excessive so that ductility is rather decreased, and surface scale defects are caused to adversely affect plated surface quality. In addition, phosphatability are deteriorated.

Therefore, Si may be included in an amount of 0.5% or less, and 0% may be excluded. More favorably, Si may be included in an amount of 0.1% or more.

Chromium (Cr): 1.0% or Less (Excluding 0%)

Chromium (Cr) is an element facilitating the formation of a bainite phase, and is an element forming a fine carbide while suppressing the formation of a martensite phase during an annealing heat treatment, thereby contributing to strength improvement.

When the content of Cr exceeds 1.0%, a bainite phase is excessively formed to decrease an elongation, and when a carbide is formed at a grain boundary, strength and the elongation may be deteriorated. In addition, manufacturing costs may be increased.

Therefore, Cr may be included in an amount of 1.0% or less, and 0% may be excluded.

Niobium (Nb): 0.1% or Less (Excluding 0%)

Niobium (Nb) is an element segregated at an austenite grain boundary, and suppressing coarsening of austenite crystal grains during an annealing heat treatment, and forming a fine carbide to contribute to strength improvement.

When the content of Nb exceeds 0.1%, a coarse carbide is precipitated, strength and an elongation may be decreased by a decreased carbon amount in steel, and manufacturing costs may be increased.

Therefore, Nb may be included in an amount of 0.1% or less, and 0% may be excluded.

Titanium (Ti): 0.1% or Less (Excluding 0%)

Titanium (Ti) is an element forming a fine carbide, and contributes to securing yield strength and tensile strength. In addition, Ti precipitates N in steel as TiN to suppress the formation of AlN by Al which is unavoidably present in steel, and thus, reduces the possibility of cracks during continuous casting.

When the content of Ti is more than 0.1%, a coarse carbide is precipitated, and strength and an elongation may be decreased by a decreased carbon amount in steel. In addition, nozzle clogging may occur during continuous casting, and manufacturing costs may be increased.

Therefore, Ti may be included in an amount of 0.1% or less, and 0% may be excluded.

Boron (B): 0.0025% or Less (Excluding 0%)

Boron (B) is an element delaying transformation of austenite into pearlite in a cooling process after an annealing heat treatment, but when the content of B exceeds 0.0025%, B is excessively concentrated on the surface and may cause deterioration in plating adhesion properties.

Therefore, B may be included in an amount of 0.0025% or less, and 0% may be excluded.

Aluminum (sol.Al): 0.02 to 0.05%

Aluminum (sol.Al) is an element added for an effect of refining a grain size of steel and deoxidation, and when the content of aluminum is less than 0.02%, aluminum killed steel cannot be manufactured in a stable state. On the other hand, when the content of aluminum exceeds 0.05%, the crystal grains are refined so that the strength may be improved, but there may be a risk of increasing surface defects of the plated steel sheet due to excessive formation of inclusions during steelmaking continuous casting operation.

Therefore, sol.Al may be included in an amount of 0.02 to 0.05%.

Phosphorus (P): 0.05% or Less (Excluding 0%)

Phosphorus (P) is a substitutional element having the greatest solid solution strengthening effect, and is an element improving in-plane anisotropy and is favorable to strength securing without significantly reducing formability. However, when P is excessively added, a possibility of brittle fraction occurrence is greatly increased, so that a possibility of sheet fracture of a slab during hot rolling is increased and plated surface properties are deteriorated.

Therefore, in the present disclosure, the content of P may be controlled to be 0.05% or less, and 0% may be excluded considering an avoidably added level.

Sulfur (S): 0.01% or Less (Excluding 0%)

Sulfur (S) is an element which is unavoidably added as an impurity element in steel, and deteriorates ductility, and thus, it is preferred to manage the content of S as low as possible. In particular, S has a problem of increasing a possibility of red heat brittleness occurrence, it is preferred to control the content of S to be 0.01% or less. However, considering the unavoidably added level during the manufacturing process, 0% may be excluded.

Nitrogen (N): 0.01% or Less (Excluding 0%)

Nitrogen (N) is a solid solution strengthening element, but when a content of nitrogen (N) exceeds 0.01%, a risk of brittleness occurrence increases, and nitrogen (N) bonds to Al in steel to precipitate an excessive amount of AlN, which may impair continuous casting quality.

Therefore, N may be included in an amount of 0.01% or less, and 0% may be excluded considering an avoidably added level.

The remaining component of the present disclosure is iron (Fe). However, since in the common manufacturing process, unintended impurities may be inevitably incorporated from raw materials or the surrounding environment, the component may not be excluded. Since these impurities are known to any person skilled in the common manufacturing process, the entire contents thereof are not particularly mentioned in the present specification.

The steel sheet of the present disclosure having the alloy composition described above may be formed of ferrite, and a bainite phase and a martensite phase as a hard phase, as a microstructure.

Specifically, the steel sheet of the present disclosure includes, by area fraction, 35 to 50% of a ferrite phase and 35 to 45% of a bainite phase. For the remainder, a martensite phase and a trace amount of residual austenite phase may be included.

The ferrite phase may be formed of non-recrystallized ferrite and recrystallization ferrite, wherein the non-recrystallization ferrite may be included in area fraction of 8 to 15%, and the recrystallized ferrite may be included in area fraction of 27 to 35%.

The higher a degree of non-recrystallization of ferrite, the higher non-uniformity in the structure, which may lead to poor processability. Therefore, it is preferable to induce the formation of a uniform structure in the steel through appropriate recrystallization.

When the fraction of the non-recrystallization ferrite is less than 8%, recrystallization is excessively performed so that there is a concern of being inferior in terms of strength. On the other hand, when the fraction exceeds 15%, the yield strength becomes excessively high as the elongated hard phase is biasedly distributed in the structure, making it difficult to secure processability.

When the fraction of the bainite phase is excessively high, the fraction of the soft phase is relatively low, making it impossible to secure a target level of formability. On the other hand, when the fraction thereof is less than 35%, there is a concern that bendability may be inferior.

The fraction of a martensite phase among the structures other than the ferrite and bainite phases, is not specifically limited, but it is advantageous that the martensite phase is included up to 20% or less by area (excluding 0%) in order to secure ultra-high strength of a tensile strength of 980 MPa or more. When the fraction of the martensite phase exceeds 20%, ductility is lowered, making it difficult to secure a target level of processability.

Meanwhile, it is advantageous that the fraction of the retained austenite phase does not exceed 3%, and even if it is 0%, it should be noted that there is no difficulty in securing intended physical properties.

The steel sheet of the present disclosure having the above-described microstructure has a thickness of 0.5 to 2.5 mm, a tensile strength of 980 MPa or more, a yield strength of 550 to 650 MPa, and an elongation (total elongation) of 12% or more, which has high strength and high ductility.

In addition, the steel sheet may have excellent bendability by having a 3-point bending angle of 90 degrees or more.

Hereinafter, a method for manufacturing a high-strength steel sheet having excellent bendability and formability according to another aspect of the present disclosure will be described in detail.

In brief, a desired steel sheet may be manufactured by performing processes of [steel slab heating—hot rolling—coiling—cold rolling—continuous annealing]. Hereinafter, each process condition will be described in detail.

[Steel Slab Heating]

First, a steel slab satisfying the alloy composition described above is prepared, which may be then heated.

This process is performed in order to smoothly perform a subsequent hot rolling process and sufficiently obtain target physical properties of the steel sheet. In the present disclosure, conditions of such a heating process are not particularly limited, there is no particular restriction on the conditions of such a heating process, and it does not matter as long as they are normal conditions. As an example, the heating process may be performed in a temperature within a range of 1100 to 1300° C.

[Hot Rolling]

The steel slab heated as described above may be hot rolled, to produce a hot-rolled steel sheet, and in this case, finish hot rolling may be performed at an outlet temperature of Ar3 or higher to 1000° C.

When the outlet temperature during the finish hot rolling is lower than Ar3, hot deformation resistance may increase rapidly, and a top portion, tail portion, and edge portion of a hot-rolled coil may become single-phase regions, resulting in increased in-plane anisotropy and deterioration in formability. Meanwhile, when the temperature is higher than 1000° C., a rolling load is relatively reduced, which is advantageous for productivity, but there may be a concern thick oxide scales may occur.

More specifically, the finish hot rolling may be performed in a temperature within a range of 760 to 940° C.

[Coiling]

The hot-rolled steel sheet manufactured as described above may be coiled into a coil shape.

The coiling may be performed in a temperature within a range of 400 to 700° C. When the coiling temperature is lower than 400° C., a martensite or bainite phase is excessively formed, resulting in an excessive increase in strength of the hot-rolled steel sheet, which may cause problems such as shape defects, or the like due to a load during subsequent cold rolling. On the other hand, when the coiling temperature is higher than 700° C., surface scales may increase, so that pickling properties may deteriorate.

[Cooling]

It is preferable to cool the coiled hot-rolled steel sheet to room temperature at an average cooling rate of 0.1° C./s or less (excluding 0° C./s). In this case, the coiled hot-rolled steel sheet may be cooled after performing processes such as transfer, stacking, and the like, and it should be noted that the process prior to cooling is not limited thereto.

As described above, by cooling the coiled hot-rolled steel sheet at a constant rate, it is possible to obtain a hot-rolled steel sheet in which carbides serving as austenite nucleation sites are finely dispersed.

[Cold Rolling]

The hot-rolled steel sheet coiled as described above may be cold rolled to produce a cold-rolled steel sheet.

In the case of a multi-stand process using a general continuous rolling mill (ex, 5 or more roll stands) in order to produce a cold-rolled steel sheet, in the technical field such as the present invention, the inventors of the present invention, have confirmed that there is no problem in rolling to a target thickness, but there is a limitation in securing material uniformity and a limitation in productivity. Accordingly, in the present disclosure, as a method capable of overcoming the limitations of the cold-rolling process described above, a method for manufacturing a cold-rolled steel sheet may be provided using an ultra-thin cold rolling mill (ZRM). For example, it may be a rolling mill in which a pair of work rolls and a plurality of backup rolls (ex. 17 to 19) are connected to the work rolls, and it should be noted that it is not limited to only this, when it is possible to reach a rolling load.

Specifically, cold rolling using the ultra-thin cold rolling mill (ZRM) may be performed in 7 passes or less, preferably in 5 to 7 passes, and may be performed in a lower pass as compared to using the existing continuous rolling mill in 8 to 14 passes.

In addition, in the present disclosure, the 7 passes or less may be set as 1 stand, and a total reduction ratio of 55% or more, preferably, it is possible to lower the pressure by 55 to 70%, which has an economically advantageous effect.

When the total reduction ratio during the cold rolling is less than 55%, ferrite recrystallization is delayed and it is difficult to obtain a fine and uniform austenite phase. On the other hand, when the total reduction ratio exceeds 70%, a yield strength is excessively increased due to excessive recrystallization and generation of fine grains, causing deterioration in workability, or during annealing, and as recrystallization and recovery excessively occur, phase transformation is suppressed, making it difficult to form a low-temperature transformation phase, and thus there is a concern that a target level of strength cannot be secured.

In the present disclosure, during cold rolling using the ultra-thin cold rolling mill, a target thickness may be achieved even with a small number of passes. However, in the case of a thick material having a thickness of 4.0 mm or more of a hot-rolled steel sheet, cold rolling may be repeatedly performed 15 to 20 times (pass) by using a reversing mill, so that a target reduction ratio can be achieved. In this case, 15 to 20 passes can be set as 1 stand. The reversing mill is a type of rolling mill used for rolling thin materials, and refers to a rolling mill that rolls while reciprocating a material between a pair of rolls, and when reciprocating the material, one way may be set 1 time (pass).

As described above, in the present disclosure, cold rolling under strong pressure may be performed, material uniformity of the cold-rolled steel sheet thus manufactured may be further improved, and the present disclosure has an effect of securing a thinner thickness than the existing cold-rolled steel sheet.

Preferably, the cold-rolled steel sheet of the present disclosure may have a thickness of 0.5 to 2.5 mm.

In the present disclosure, it should be noted that a hot-rolled steel sheet may be pickled before the cold rolling, and the pickling process may be performed in a conventional manner.

[Continuous Annealing]

It is preferable to subject the cold-rolled steel sheet manufactured according to the above to continuous annealing. The continuous annealing treatment may be performed in, for example, a continuous annealing furnace (CAL).

In general, a continuous annealing furnace (CAL) may be composed of [heating zone—soaking zone—cooling zone (slow cooling zone and rapid cooling zone)—(overaging zone, if necessary)]. The cold-rolled steel sheet is charged into such a continuous annealing furnace, then heated to a specific temperature in the heating zone, and after reaching a target temperature, is maintained in the soaking zone for a certain period of time.

In the present disclosure, during the continuous annealing, a temperature of the heating zone and the soaking zone can be equally controlled, which means that an end temperature of the heating zone and a start temperature of the soaking zone are equally controlled.

Specifically, the temperature of the heating zone and the soaking zone may be controlled to be 770 to 810° C. When the temperature is lower than 770° C., heat input for recrystallization cannot be applied. On the other hand, when the temperature is higher than 810° C., productivity is lowered and an austenite phase is excessively formed, so that a fraction of a hard phase after subsequent cooling increases significantly, resulting in poor ductility of the steel.

[Stepwise Cooling]

A target structure may be formed by cooling the continuously annealed cold-rolled steel sheet according to the above, and in this case, it is preferable to perform cooling stepwise.

In the present disclosure, the stepwise cooling may be composed of primary cooling—secondary cooling, and specifically, after the continuous annealing, primary cooling is performed at an average cooling rate of 1 to 10° C./s to a temperature within a range of 650 to 700° C., and then secondary cooling may be formed at an average cooling rate of 5 to 50° C./s to a temperature within a range of 300 to 580° C.

In this case, by performing the first cooling more slowly than the second cooling, it is possible to suppress a plate shape defect due to a rapid temperature drop during the second cooling, which is a relatively rapid cooling section.

When the end temperature of the primary cooling is lower than 650° C., a degree of diffusion activity of carbon is low due to a too low temperature, so that a carbon concentration in ferrite is high. On the other hand, as the carbon concentration in austenite decreases, the fraction of a hard phase becomes excessive and a yield ratio increases, thereby increasing a tendency to generate cracks during processing. In addition, a cooling rate of the soaking zone and the cooling zone (slow cooling zone) becomes too high, causing a problem that a shape of a plate becomes non-uniform. When the end temperature is higher than 700° C., there is a disadvantage in that an excessively high cooling rate is required during subsequent cooling (secondary cooling).

In addition, when an average cooling rate during the primary cooling exceeds 10° C./s, carbon diffusion may not sufficiently occur. Meanwhile, a primary cooling process may be performed at an average cooling rate of 1° C./s or more, in consideration of productivity.

After the primary cooling is completed as described above, rapid cooling (secondary cooling) may be performed at a cooling rate equal to or higher than a certain level. In this case, when a secondary cooling end temperature is lower than 300° C., cooling deviation occurs in the width and length directions of the steel sheet, and there is a possibility that the sheet shape may be deteriorated. On the other hand, when the secondary cooling end temperature is higher than 580° C., a hard phase cannot be sufficiently secured, so that the strength may be reduced.

In addition, when an average cooling rate during the secondary cooling is less than 5° C./s, there is a concern that a fraction of the hard phase may be excessive, while when the average cooling rate during the secondary cooling exceeds 50° C./s, there is a concern that the hard phase may be rather insufficient.

Meanwhile, if necessary, after completing the stepwise cooling, an overaging treatment may be performed.

The overaging treatment is a process of maintaining the steel sheet for a predetermined time after the secondary cooling end temperature, and has an effect of improving shape quality by performing a uniform heat treatment in a width direction and a length direction of a coil. To this end, the overaging treatment may be performed for 200 to 800 seconds.

Since the overaging treatment may be performed immediately after the end of the secondary cooling, the temperature may be the same as the secondary cooling end temperature, or may be performed within a range of the secondary cooling end temperature.

The high-strength steel sheet of the present disclosure manufactured as described above has a microstructure comprising a hard phase and a soft phase, and in particular, by maximizing ferrite recrystallization by an optimized cold rolling and annealing process, the high-strength steel sheet may have a structure in which bainite and martensite phases, which are hard phases, are uniformly distributed, in the finally recrystallized ferrite matrix.

From this, the steel sheet of the present disclosure may secure excellent bendability and formability by securing a low yield ratio and high ductility even though it has a high strength of a tensile strength of 980 MPa or more.

Hereinafter, the present disclosure will be specifically described through the following Examples. However, it should be noted that the following Examples are only for describing the present disclosure in detail by illustration, and are not intended to limit the right scope of the present disclosure. The reason is that the right scope of the present disclosure is determined by the matters described in the claims and reasonably inferred therefrom.

MODE FOR INVENTION

Example

After a steel slab having the alloy composition shown in the following Table 1 was manufactured, each steel slab was heated at 1200° C. for 1 hour and was then finish hot rolled at a finish rolling temperature of 880 to 920° C., to manufacture a hot-rolled steel sheet. In this case, a thickness of each hot-rolled steel sheet was 2.1 to 3.5 mm, and in the case of steels having a thickness of a cold-rolled material of 0.8 mm (see Table 2), the thickness of the hot-rolled steel sheet was 8 mm.

Thereafter, each hot-rolled steel sheet was coiled at 650° C. and then cooled to room temperature at a cooling rate of 0.1° C./s. Thereafter, the coiled hot-rolled steel sheet was subjected to cold rolling and continuous annealing under the conditions shown in the following Table 2, and was then cooled stepwise (primary—secondary), and was then overaged at 360° C. for 520 seconds to manufacture a final steel sheet.

In this case, primary cooling was performed at an average cooling rate of 3° C./s and secondary cooling was performed at an average cooling rate of 20° C./s, in the stepwise cooling.

The microstructure of each steel sheet manufactured as described above was observed, the tensile and mechanical properties thereof were evaluated, and then the results were shown in the following Table 3.

In this case, a tensile test for each specimen was performed at a strain rate of 0.01/s after collecting a tensile specimen of a JIS No. 5 size in a vertical direction to a rolling direction.

Meanwhile, a 3-point bending test for evaluating bendability was performed in accordance with a VDA standard (VDA238-100) prescribed by the German Automobile Manufacturers Association, and by measuring a displacement at a maximum load measured by the bending test was converted into an angle in accordance with the VDA standard, a bending angle was measured. In this case, a size of the specimen was 60 mm×60 mm, a bending roll diameter was 30 mm, a gap between rolls was 2.9 mm, a punch R value was 0.4 mm, and a punch press-in speed was 20 mm/min.

Further, among the structural phases, bainite and martensite phases, corresponding to the hard phase were observed at 5000 magnification by SEM after nital etching. In this case, a fraction of the observed hard phase was measured. Each fraction of other phases and the like was measured using SEM and an image analyzer after nital etching. In this case, non-recrystallized ferrite was expressed as a fraction of ferrite having a deformed structure in a total fraction of ferrite by an image analyzer.

In addition, in order to check whether a standard of weldability was satisfied after processing an automobile structure, a carbon equivalent ($C_{eq}$) value was measured, and calculated according to the following formula.

$$C_{eq}(\%)=C+(Si/30)+(Mn/20)+2P+4S \quad \text{Formula (1)}$$

where, each element refers to a weight content (%)

TABLE 1

| | Alloy composition (weight %) | | | | | | | | | | |
|---|---|---|---|---|---|---|---|---|---|---|---|
| Steel No. | C | Mn | Si | Cr | Nb | Ti | B* | sol. Al | P | S | N* |
| 1 | 0.083 | 2.29 | 0.406 | 0.836 | 0.049 | 0.0019 | 24 | 0.034 | 0.0086 | 0.0008 | 52 |
| 2 | 0.061 | 2.89 | 0.402 | 0.856 | 0.051 | 0.0202 | 22 | 0.036 | 0.0099 | 0.0016 | 45 |
| 3 | 0.068 | 2.27 | 0.399 | 0.850 | 0.047 | 0.0205 | 22 | 0.039 | 0.0094 | 0.0008 | 52 |
| 4 | 0.071 | 2.60 | 0.411 | 0.841 | 0.049 | 0.0198 | 23 | 0.037 | 0.0097 | 0.0007 | 44 |

TABLE 1-continued

| Steel No. | Alloy composition (weight %) | | | | | | | | | | |
|---|---|---|---|---|---|---|---|---|---|---|---|
| | C | Mn | Si | Cr | Nb | Ti | B* | sol. Al | P | S | N* |
| 5 | 0.090 | 2.12 | 0.395 | 0.833 | 0.048 | 0.0203 | 21 | 0.032 | 0.0073 | 0.0024 | 33 |
| 6 | 0.111 | 2.08 | 0.120 | 0.980 | 0.048 | 0.0210 | 23 | 0.026 | 0.0089 | 0.0009 | 55 |

B* and N* are represented in units of ppm

TABLE 2

| Steel No. | Cold rolling | | | Annealing and Cooling | | | Division |
|---|---|---|---|---|---|---|---|
| | Total reduction ratio (%) | Number of passes (Times ) | Final thickness (mm) | Annealing temperature (° C.) | Primary cooling end temperature (° C.) | Secondary cooling end temperature (° C.) | |
| 1 | 39 | 3 | 1.3 | 760 | 650 | 450 | Comparative example 1 |
| 2 | 42 | 3 | 1.3 | 760 | 650 | 450 | Comparative example 2 |
| 3 | 48 | 5 | 1.3 | 760 | 650 | 450 | Comparative example 3 |
| 4 | 55 | 5 | 1.3 | 770 | 650 | 450 | Inventive example 1 |
| 5 | 62 | 7 | 1.3 | 770 | 650 | 450 | Inventive example 2 |
| 5 | 90 | 17 | 0.8 | 770 | 650 | 450 | Comparative example 4 |
| 6 | 90 | 17 | 0.8 | 770 | 650 | 450 | Comparative example 5 |
| 1 | 39 | 3 | 1.3 | 790 | 650 | 450 | Comparative example 6 |
| 2 | 42 | 3 | 1.3 | 790 | 650 | 450 | Comparative example 7 |
| 3 | 48 | 5 | 1.3 | 790 | 650 | 450 | Comparative example 8 |
| 4 | 55 | 5 | 1.3 | 790 | 650 | 450 | Inventive example 3 |
| 5 | 62 | 7 | 1.3 | 790 | 650 | 450 | Inventive example 4 |
| 5 | 90 | 17 | 0.8 | 790 | 650 | 450 | Comparative example 9 |
| 6 | 90 | 17 | 0.8 | 790 | 650 | 450 | Comparative example 10 |
| 1 | 39 | 3 | 1.3 | 810 | 650 | 450 | Comparative example 11 |
| 2 | 42 | 3 | 1.3 | 810 | 650 | 450 | Comparative example 12 |
| 3 | 48 | 5 | 1.3 | 810 | 650 | 450 | Comparative example 13 |
| 4 | 55 | 5 | 1.3 | 810 | 650 | 450 | Inventive example 5 |
| 5 | 62 | 7 | 1.3 | 810 | 650 | 450 | Inventive example 6 |
| 5 | 90 | 17 | 0.8 | 810 | 650 | 450 | Comparative example 14 |
| 6 | 90 | 17 | 0.8 | 810 | 650 | 450 | Comparative example 15 |

Annealing temperature represents a temperature of a heating zone and a soaking zone.

TABLE 3

| Division | Microstructure (area fraction %) | | | | | Mechanical properties | | | | | |
|---|---|---|---|---|---|---|---|---|---|---|---|
| | Recrystallization F | Non-recrystallization F | B | M | R-A | YS (MPa) | TS (MPa) | Yield ratio (YS/TS) | El (%) | 3-point Bending angle (°) | $C_{eq}$ (%) |
| Comparative Example 1 | 3.24 | 32.76 | 40 | 23 | 1 | 766 | 1179 | 0.65 | 10.7 | 74 | 0.231 |
| Comparative Example 2 | 14.82 | 24.18 | 38 | 22 | 1 | 756 | 1158 | 0.65 | 9.9 | 84 | 0.245 |
| Comparative Example 3 | 18 | 22 | 42 | 17 | 1 | 616 | 1081 | 0.57 | 13.6 | 87 | 0.217 |
| Inventive Example 1 | 34 | 15 | 38 | 12 | 1 | 553 | 1034 | 0.53 | 12.5 | 90 | 0.237 |
| Inventive Example 2 | 33.84 | 13.16 | 38 | 14 | 1 | 598 | 1077 | 0.55 | 13.6 | 99 | 0.233 |
| Comparative Example 4 | 46.55 | 2.45 | 34 | 16 | 1 | 605 | 970 | 0.62 | 17.6 | 102 | 0.233 |
| Comparative Example 5 | 49.4 | 2.6 | 38 | 9 | 1 | 456 | 888 | 0.51 | 17.2 | 108 | 0.240 |
| Comparative Example 6 | 3.85 | 31.15 | 44 | 20 | 1 | 729 | 1151 | 0.63 | 11.1 | 82 | 0.231 |
| Comparative Example 7 | 15.2 | 22.8 | 42 | 19 | 1 | 716 | 1137 | 0.63 | 10.4 | 79 | 0.245 |
| Comparative Example 8 | 19.27 | 21.73 | 41 | 17 | 1 | 646 | 1078 | 0.60 | 11.5 | 93 | 0.217 |
| Inventive Example 3 | 28.8 | 11.2 | 45 | 14 | 1 | 582 | 1040 | 0.56 | 14.5 | 98 | 0.237 |
| Inventive Example 4 | 31.92 | 10.08 | 41 | 16 | 1 | 610 | 1070 | 0.57 | 14.3 | 94 | 0.233 |
| Comparative Example 9 | 34.2 | 1.8 | 45 | 18 | 1 | 667 | 1055 | 0.63 | 16.2 | 103 | 0.233 |
| Comparative Example 10 | 39.9 | 2.1 | 46 | 11 | 1 | 527 | 989 | 0.53 | 16.2 | 107 | 0.240 |
| Comparative Example 11 | 4.32 | 31.68 | 43 | 20 | 1 | 730 | 1110 | 0.66 | 9.9 | 96 | 0.231 |
| Comparative Example 12 | 15.91 | 21.09 | 44 | 18 | 1 | 704 | 1099 | 0.64 | 10.5 | 92 | 0.245 |
| Comparative Example 13 | 19 | 19 | 43 | 18 | 1 | 706 | 1073 | 0.66 | 11.5 | 93 | 0.217 |
| Inventive Example 5 | 28.12 | 9.88 | 43 | 18 | 1 | 647 | 1061 | 0.62 | 14.2 | 101 | 0.237 |
| Inventive Example 6 | 27.72 | 8.28 | 44 | 19 | 1 | 648 | 1073 | 0.63 | 12.1 | 106 | 0.233 |
| Comparative Example 14 | 28.25 | 1.75 | 45 | 24 | 1 | 720 | 1078 | 0.67 | 15.7 | 108 | 0.233 |
| Comparative Example 15 | 30.05 | 1.95 | 44 | 23 | 1 | 657 | 1063 | 0.62 | 16.3 | 108 | 0.240 |

F: Ferrite
B: Bainite
M: Martensite
R-A: Retained austenite
YS: Yield strength
TS: Tensile strength
El: Elongation As illustrated in Tables 1 to 3, in Inventive Examples 1 to 6 in which the steel alloy composition and the manufacturing conditions, in particular, a cold rolling and continuous annealing process satisfied all of the suggestions in the present disclosure, ferrite recrystallization sufficiently occurred in the annealing process after cold rolling, and it not only had high strength and yield strength which is advantageous to plate shape processing, but also had excellent elongation and 3-point bendability, and it could be confirmed therefrom that a target level of formability may be secured.

In particular, in the Inventive Examples, material uniformity of the steel sheet is improved since the fraction of recrystallized ferrite is formed to be 27% or more. Recrystallization of steel is a phenomenon in which ferrite atoms are rearranged during annealing. The higher the degree of recrystallization, the more austenite transformation occurs in various directions, and the higher the material uniformity of the steel as a whole, which is advantageous for improving processability.

On the other hand, in Comparative Examples 1 to 2 in which a soaking temperature during continuous annealing was low and a cold reduction ratio was low, during the steel sheet manufacturing process, yield strength and tensile strength appeared to be excessively high due to an excessive ferrite phase in which recrystallization did not occur sufficiently, and elongation and 3-point bending angle were also low, resulting in poor processability. In addition, in Comparative Example 3, a soaking temperature during continuous annealing was low and a cold reduction ratio was low, so it can be confirmed that a non-recrystallized ferrite phase was excessively formed so that a 3-point bending angle was poor.

In Comparative Examples 6, 7, and 11 to 13, an annealing temperature for driving recrystallization satisfied the present disclosure, but an elongated hard phase was developed by controlling the total reduction ratio during cold rolling to be less than 55%, and accordingly, the yield strength and the tensile strength were excessively high, resulting in poor processability.

In Comparative Example 8, the total reduction ratio was less than 55% during cold rolling, but the reduction ratio was higher than that of Comparative Examples 6 or 7, so that in terms of processability, it satisfied a level of the present disclosure, but ductility was inferior.

In Comparative Examples 4-5, 9-10, and 14-15, a total reduction ratio during cold rolling was 90%, which was very excessive.

Thereamong, in Comparative Examples 4 to 5 and 10, recrystallization proceeded excessively during annealing after cold rolling, and reverse transformation of austenite is suppressed, resulting in poor strength. Since the reverse transformation of austenite does not occur well in recrystallized ferrite, the reverse transformation of austenite can be suppressed in an environment where a driving force for recrystallization is very high, and accordingly, the fraction of martensite decreases during cooling or the fraction of ferrite in the final structure appeared to be high.

In Comparative Example 9, the yield strength was excessively increased due to a crystal grain refinement effect due to an excessive reduction ratio, making it difficult to mold and increasing the processing costs.

In Comparative Examples 14 and 15, as austenite was excessively formed during an annealing process due to annealing at a relatively high temperature, in addition to strong rolling, a fraction of the hard phase also increased during cooling, and the yield strength was exceeded.

Figure 2:
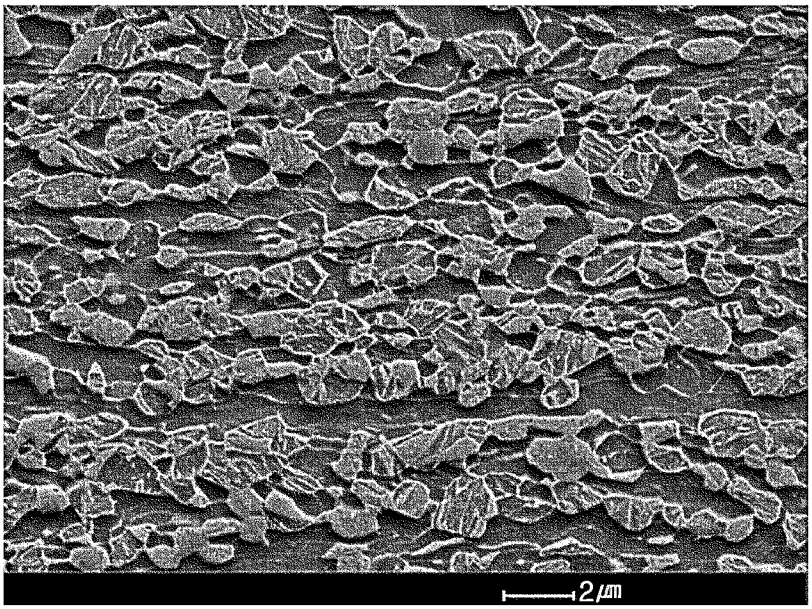
FIG. 2 illustrates a photograph of a microstructure of Comparative Steel according to an embodiment of the present disclosure.
Figure 2:
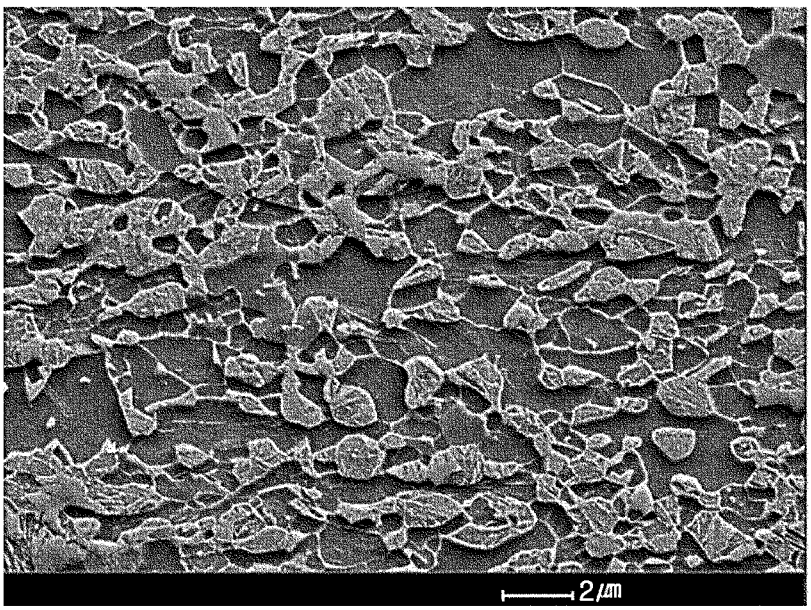

FIG. 1 is images of microstructures of Inventive Examples 3 and 4, and FIG. 2 is images of microstructures of Comparative Examples 6 and 7.

As shown in FIG. 1, it can be confirmed that the steel sheet according to the present disclosure has a homogeneous and fine bainite phase and a certain fraction of martensite phase formed on a sufficient fraction of a recrystallized ferrite matrix.

On the other hand, as shown in FIG. 2, it can be confirmed that ferrite is formed by being elongated in a rolling direction, and it can be seen that bainite is formed in the same form due to lack of recrystallization. Since the fraction of such bainite is high, the yield strength and yield ratio are excessively high, and it can be seen that formability is poor.

Figure 3:
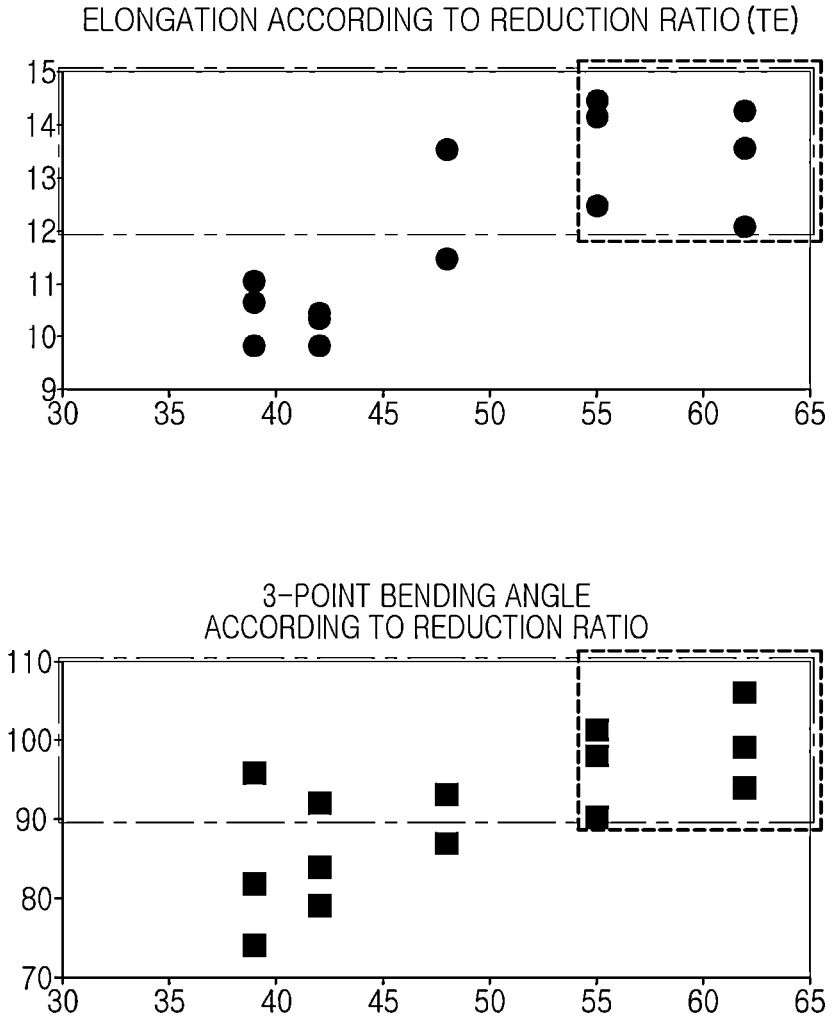
FIG. 3 is a graph illustrating a change in physical properties according to a reduction ratio during cold rolling in an embodiment of the present disclosure.
Figure 4:
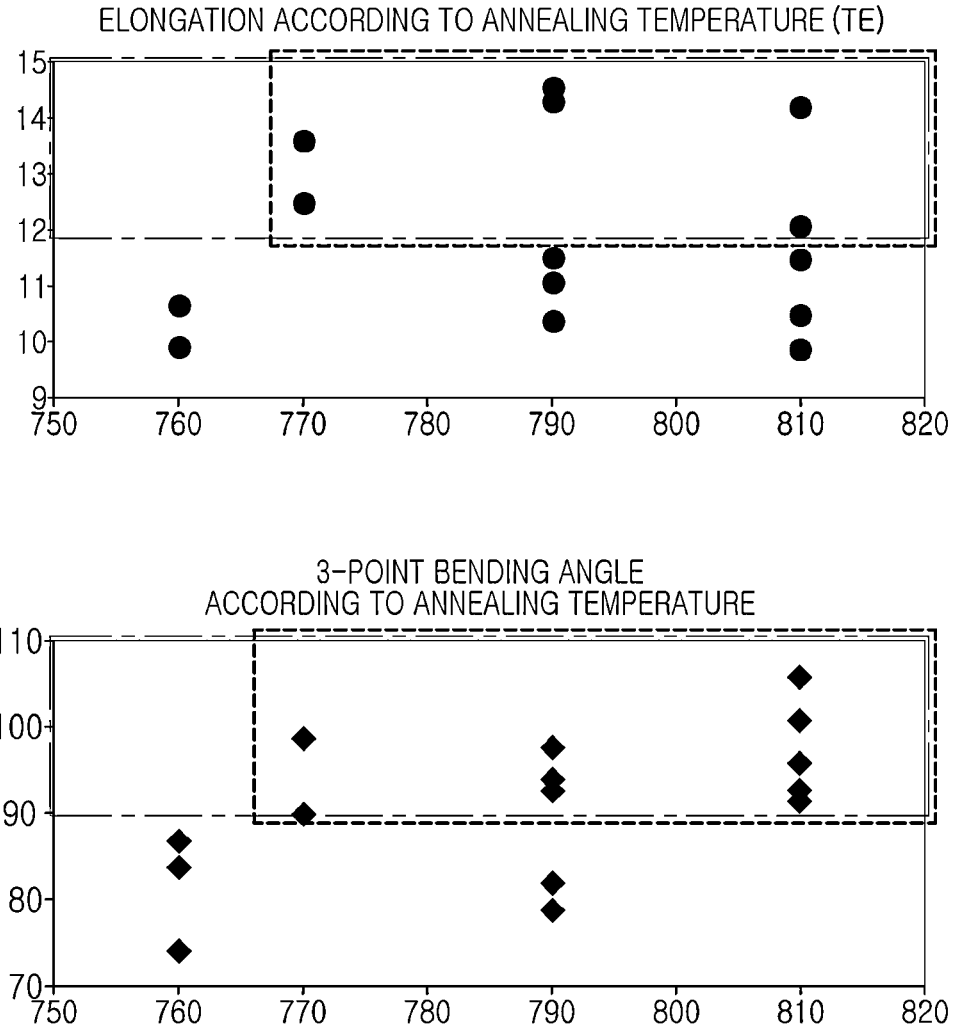
FIG. 4 is a graph illustrating a change in physical properties according to an annealing temperature in an embodiment of the present disclosure.

FIG. 3 is a graph illustrating a change in workability according to a reduction ratio during cold rolling, and FIG. 4 is a graph illustrating a change in workability according to an annealing temperature.

As shown in FIG. 3, when a reduction ratio during cold rolling under the annealing conditions proposed in the present disclosure is 55% or more, it can be seen that elongation and a 3-point bending angle may be simultaneously satisfied.

Meanwhile, when a reduction ratio of 45% or more is applied during cold rolling, the elongation and the 3-point bending angle may be improved, but in order to secure the workability targeted in the present disclosure, it can be recognized that it is necessary to control the alloy composition, annealing conditions, and the like, for controlling phase transformation and recrystallization (FIG. 4).

While example embodiments have been shown and described above, it will be apparent to those skilled in the art that modifications and variations could be made without departing from the scope of the present disclosure as defined by the appended claims.

The invention claimed is:

1. A high-strength steel sheet having excellent bendability and formability, the steel sheet comprising:

by weight, 0.05 to 0.12% of carbon (C), 2.0 to 3.0% of manganese (Mn), 0.5% or less excluding 0% of silicon (Si), 1.0% or less excluding 0% of chromium (Cr), 0.1% or less excluding 0% of niobium (Nb), 0.1% or less excluding 0% of titanium (Ti), 0.0025% or less excluding 0% of boron (B), 0.02 to 0.05% of aluminum (sol.Al), 0.05% or less excluding 0% of phosphorus (P), 0.01% or less excluding 0% of sulfur(S), 0.01% or less excluding 0% of nitrogen (N), with a balance of Fe and inevitable impurities; and a microstructure comprising, by area fraction, 35 to 50% of ferrite, 35 to 45% of bainite, and a balance of martensite, wherein the ferrite includes a non-recrystallized ferrite, by area fraction, in a range of 8 to 15% of a total amount of the microstructure, and a recrystallized ferrite, by area fraction, in a range of 27 to 35% of the total amount of the microstructure.

2. The high-strength steel sheet having excellent bendability and formability of claim 1, wherein the microstructure further comprises, by 20% or less excluding 0% of a martensite phase.

3. The high-strength steel sheet having excellent bendability and formability of claim 1, wherein the microstructure further comprises, by area fraction, 3% or less excluding 0% of a retained austenite phase.

4. The high-strength steel sheet having excellent bendability and formability of claim 1, further comprising: a tensile strength of 980 MPa or more, a yield strength of 550 to 650 MPa, and a total elongation of 12% or more.

5. The high-strength steel sheet having excellent bendability and formability of claim 1, further comprising: a 3-point bending angle of 90 degrees or more.

6. The high-strength steel sheet having excellent bendability and formability of claim 1, further comprising: a thickness of 0.5 to 2.5 mm.

7. A metho for manufacturing the high-strength steel sheet having excellent bendability and formability of claim 1, comprising operations of:

preparing a steel slab including by weight:

0.05 to 0.12% of carbon (C), 2.0 to 3.0% of manganese (Mn), 0.5% or less excluding 0% of silicon (Si), 1.0% or less excluding 0% of chromium (Cr), 0.1% or less excluding 0% of niobium (Nb), 0.1% or less excluding 0% of titanium (Ti), 0.0025% or less excluding 0% of boron (B), 0.02 to 0.05% of aluminum (sol.Al), 0.05% or less excluding 0) of phosphorus (P), 0.01% or less excluding 0% of sulfur(S), 0.01% or less excluding 0% of nitrogen (N), with a balance of Fe and inevitable impurities;

heating the steel slab at a temperature within a range of 1100 to 1300° C.;

subjecting the heated steel slab to hot rolling to manufacture a hot-rolled steel sheet;

coiling the hot-rolled steel sheet at a temperature within a range of 400 to 700° C.;

cooling the hot-rolled steel sheet to room temperature after coiling;

subjecting the cooled hot-rolled steel sheet to cold rolling to manufacture a cold-rolled steel sheet;

continuously annealing the cold-rolled steel sheet;

primary cooling the steel sheet to a temperature within a range of 650 to 700° C. at an average cooling rate of 1 to 10° C./s after the continuous annealing; and secondary cooling the steel sheet to a temperature within a range of 300 to 580° C. at an average cooling rate of 5 to 50° C./s after the primary cooling, wherein the cold rolling is performed in 7 passes or less, and a total reduction ratio is 55 to 70%.

8. The method for manufacturing a high-strength steel sheet having excellent bendability and formability of claim 7, wherein, in the hot rolling, finish hot rolling is performed at an outlet temperature of Ar3 or higher to 1000° C.

9. The method for manufacturing a high-strength steel sheet having excellent bendability and formability of claim 7, wherein the cooling after the coiling is performed at a cooling rate of 0.1° C./s or less excluding 0° C./s.

10. The method for manufacturing a high-strength steel sheet having excellent bendability and formability of claim 7, wherein the continuous annealing is performed in a facility having a heating zone, a soaking zone, and a cooling zone, wherein the heating zone and the soaking zone are controlled to be in a temperature within a range of 770 to 810° C.

11. The method for manufacturing a high-strength steel sheet having excellent bendability and formability of claim 7, further comprising an operation of:

performing an overaging treatment after the secondary cooling, wherein the overaging treatment is performed for 200 to 800 seconds.

12. The method for manufacturing a high-strength steel sheet having excellent bendability and formability of claim 7, wherein when the thickness of the hot-rolled steel sheet is 4 mm or more, the cold rolling is performed in 15 to 20 passes using a reversing mill.

* * * * *